US009517916B2

(12) United States Patent
Swanson et al.

(10) Patent No.: US 9,517,916 B2
(45) Date of Patent: Dec. 13, 2016

(54) MANDREL WITH WIRE RETAINER

(71) Applicant: REELEX Packaging Solutions, Inc., Patterson, NY (US)

(72) Inventors: Mark Swanson, Millerton, NY (US); Eric Nelson, Brewster, NY (US)

(73) Assignee: REELEX Packaging Solutions, Inc., Patterson, NY (US)

( * ) Notice: Subject to any disclaimer, the term of this patent is extended or adjusted under 35 U.S.C. 154(b) by 374 days.

(21) Appl. No.: 14/306,632

(22) Filed: Jun. 17, 2014

(65) Prior Publication Data

US 2015/0360904 A1 Dec. 17, 2015

(51) Int. Cl.

| | |
|---|---|
| ***B65H 54/58*** | (2006.01) |
| ***B65H 55/04*** | (2006.01) |
| ***B65H 75/24*** | (2006.01) |
| ***B65H 75/28*** | (2006.01) |

(52) U.S. Cl.

CPC ..... *B65H 75/28* (2013.01); *B65H 54/58* (2013.01); *B65H 55/046* (2013.01); *B65H 75/242* (2013.01); *B65H 75/248* (2013.01)

(58) Field of Classification Search

CPC ..... B65H 75/24; B65H 75/242; B65H 75/248; B65H 75/28; B65H 75/285; B65H 54/58; B65H 55/046

See application file for complete search history.

(56) References Cited

U.S. PATENT DOCUMENTS

| | | | |
|---|---|---|---|
| 2,634,922 | A | 4/1953 | Taylor, Jr. |
| 5,470,026 | A | 11/1995 | Kotzur |
| 5,678,778 | A | 10/1997 | Kotzur et al. |
| 5,803,394 | A | 9/1998 | Kotzur et al. |
| 5,810,272 | A | 9/1998 | Wallace et al. |
| 5,938,260 | A | 8/1999 | Wallace et al. |
| 5,979,812 | A | 11/1999 | Kotzur et al. |
| 6,086,012 | A | 7/2000 | Kotzur et al. |
| 6,109,554 | A | 8/2000 | Kotzur et al. |
| 6,341,741 | B1 | 1/2002 | Kotzur et al. |
| 6,491,163 | B1 | 12/2002 | Grcic et al. |
| 6,702,213 | B2 | 3/2004 | Kotzur et al. |
| 6,766,627 | B2 | 7/2004 | Kotzur et al. |
| 7,100,346 | B2 | 9/2006 | Kotzur et al. |
| D541,145 | S | 4/2007 | Copp |

(Continued)

OTHER PUBLICATIONS

U.S. Appl. No. 13/887,502, filed May 6, 2013, Timothy M. Copp et al.

(Continued)

*Primary Examiner* — William E Dondero

(74) *Attorney, Agent, or Firm* — Gordon & Jacobson, P.C.

(57) ABSTRACT

A mandrel for the winding of wire includes a central element and segments radially extending about and respectively coupled to the central element by rotatable arms that permit the segments to assume a collapsed position and an extended position Inner surfaces of the segments define slots in which ends of the arms extend. One segment also defines a radially extending groove on an outer surface of that segment which intersects with the slot of that segment to define an opening through the segment. A resilient pad is fixed in the slot of that segment and has a face located at the opening and adjacent a surface of an arm coupling that segment to the central element. A wire is threaded into the opening and held in place when the arms are rotated to cause the segments to assume the extended position. Methods using the mandrel are disclosed.

17 Claims, 3 Drawing Sheets

Section A-A

(56) References Cited

U.S. PATENT DOCUMENTS

| | | | |
|---|---|---|---|
| 7,249,726 | B2 | 7/2007 | Kotzur |
| 8,191,337 | B2 | 6/2012 | Moore |
| 8,794,438 | B2 | 8/2014 | Copp et al. |
| 2013/0146696 | A1 | 6/2013 | Copp et al. |
| 2013/0283735 | A1 | 10/2013 | Copp et al. |
| 2014/0069056 | A1 | 3/2014 | Swanson et al. |
| 2014/0075883 | A1 | 3/2014 | Kotzur et al. |
| 2014/0077469 | A1 | 3/2014 | Kotzur et al. |
| 2014/0208700 | A1 | 7/2014 | Gamble et al. |

OTHER PUBLICATIONS

U.S. Appl. No. 13/950,908, filed Jul. 25, 2013, Timothy M. Copp et al.

U.S. Appl. No. 13/573,362, filed Sep. 12, 2012, Timothy M. Copp et al.

U.S. Appl. No. 14/306,632, filed Jun. 17, 2014, Mark Swanson et al.

Section A-A

MANDREL WITH WIRE RETAINER

BACKGROUND OF THE INVENTION

1. Field

The subject disclosure relates to mandrels. More particularly, the subject disclosure relates to a mandrel that grabs and holds wires or filaments to the mandrel around which the wire or filament is wound.

2. State of the Art

U.S. Pat. No. 2,634,922 to Taylor describes the winding of flexible wire, cable or filamentary material (hereinafter "wire", which is to be broadly understood in the specification and claims) around a mandrel in a figure-eight pattern such that a package of material is obtained having a plurality of layers surrounding a central core space. By rotating the mandrel and by controllably moving a traverse that guides the wire laterally relative to mandrel, the layers of the figure-eight pattern are provided with aligned holes (cumulatively a "pay-out hole") such that the inner end of the flexible material may be drawn out through the payout hole. When a package of wire is wound in this manner, the wire may be unwound through the payout hole without rotating the package and without kinking This provides a major advantage to the users of the wire.

Over the past fifty-plus years, improvements have been made to the original invention described in U.S. Pat. No. 2,634,922. For example, U.S. Pat. No. 5,470,026 to Kotzur describes means for controlling the reciprocating movement of the traverse with respect to the rotation of the mandrel in order to wind the filamentary materials on the mandrel to form a radial payout hole having a substantially constant diameter. In addition, over the past fifty-plus years, an increasing number of different types of wires with different characteristics are being wound using the systems and methods described in U.S. Pat. No. 2,635,922 and the subsequent improvements. For example, the figure-eight type winding has been used for Category 5 type cable, drop cable, fiber-optic cable, electronic building wire (THHN), etc. Despite the widespread applicability of the technology, challenges remain in applying the technology to different wires.

SUMMARY OF THE INVENTION

This summary is provided to introduce a selection of concepts that are further described below in the detailed description. This summary is not intended to identify key or essential features of the claimed subject matter, nor is it intended to be used as an aid in limiting the scope of the claimed subject matter.

In one embodiment, a mandrel useful for winding wire thereabout is provided with a central element and a plurality of radially attached bowed segments that are movable from a first collapsed position where the segments are closer to the central element and to each other to a second expanded or extended position where the segments are further from the central element and are spaced further from each other. One or more movable arms couple each segment to the central element in order to move the segments back and forth between the first and second positions, and the segments each define at least one horizontal interior slot in which the arm of that segment is accommodated as it rotates into the first collapsed position. At least one of the segments is provided with a radially extending groove that extends radially across a substantial portion of the bowed segment along the outer surface of the segment. The radially extending groove intersects the interior slot, thereby providing an opening from the exterior of that segment to the interior of that segment. A resilient pad is fixed in the slot of the segment provided with the radial groove and is located adjacent the opening where the slot and groove intersect. The arm of the segment is located so that when the arm is an extended position, the arm either contacts the resilient pad or is within a distance of less than a diameter of a wire that is to wound around the mandrel. When the arm is rotated towards a collapsed position, the arm moves away from the resilient pad.

In one aspect, with the provided arrangement, the end of a wire that is to be wound around the mandrel can be inserted from the radial groove side into the opening defined by the radial groove and the slot of the segment when the segment is in its collapsed position. The segment may then be moved into its extended position, and the wire will be squeezed between the resilient pad and the arm and will extend along the radial groove until it reaches the surface of the segment. The wire can then be wound around the mandrel by placing the central element on a motor shaft, and running the motor which rotates the mandrel, and by controllably moving a traverse that guides the wire laterally relative to mandrel. When a desired length of wire is wound, the package on the mandrel can be removed from the mandrel by cutting the wire (if necessary), collapsing the mandrel from its extended position into the collapsed position, thereby releasing the wire from between the resilient pad and the arm, and lifting the package off of the mandrel.

In one aspect, the provided mandrel is particularly useful with brittle wire.

In one embodiment, the resilient pad is fixed in the slot by attaching the pad to a non-resilient support element that is fixed in the slot. The non-resilient support element may be a metal spacer that is screwed onto the segment. In one embodiment, the metal spacer may be movable in the slot to a plurality of different locations and then fixed at a desired one of the plurality of different locations.

In one embodiment, the slot mandrel segments are curved in two directions so that the segments form a barrel-shaped form.

Additional aspects of the subject disclosure will become evident to those of ordinary skill in the art upon reference to the drawings, specification, and claims hereof.

DETAILED DESCRIPTION OF THE PREFERRED EMBODIMENTS

Figure 1:
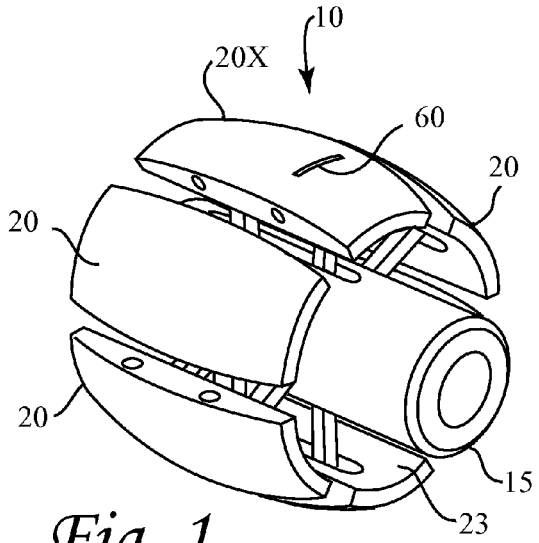
FIG. 1 is a perspective view of an embodiment of a mandrel in an expanded position with a wire retainer.
Figure 2:
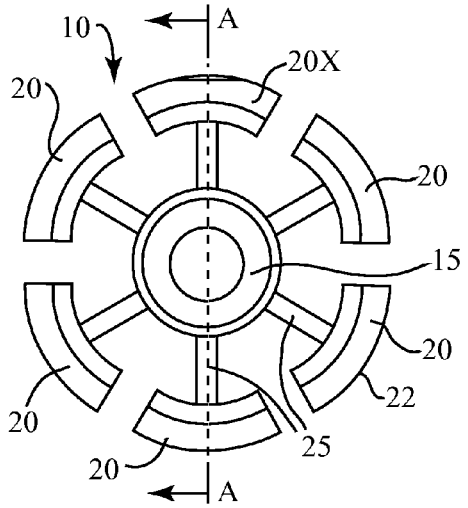
FIG. 2 is a front view of the mandrel of FIG. 1 in an expanded position.

A mandrel 10 with a wire retainer is seen in FIGS. 1-7. Mandrel 10 is shown with a central hollow cylindrical element 15 and a plurality of radially attached segments 20 (one shown as 20X). While six segments are shown, it will be appreciated that fewer or more segments could be utilized. Each segment is shown with an outer surface 22 that is bowed out (convex) in two directions. Each segment is also shown with an inner surface 23 that is concave in at least one direction. Each segment is coupled to the central element 15 via at least one arm or rod 25 (one shown as 25X in FIGS. 3 and 5). In the shown embodiment, two rods are used for each segment. Each of the rods define holes 30 that receive pins 32 that extend into bushings 34 located in corresponding holes 36 in the segment 20 and into corresponding holes (not shown) of the central element 15. Set screws 37 may be used to help hold the pins in the bushings. As a result, the arms may rotate around the pins and cause the segments 20 to rotate from a first collapsed position (FIGS. 6 and 7) where the segments are closer to the central element 15 and to each other, to a second expanded or extended position shown in FIGS. 1-4 where the segments are further from the central element and are spaced further from each other. In the first collapsed position, the segments may touch each other or be very closely adjacent each other. In the first collapsed position, the segments take the shape of a bumpy barrel. In the second expanded or extended position seen in FIGS. 1-4, the segments are spaced from one another and their outer surfaces 22 appear at any cross-section to define a circle, although again, the circle may be slightly bumpy. Although not shown, a lock may be provided to keep the segments in the expanded position and/or in the collapsed position.

As shown in FIGS. 1-4, in the expanded position, the arms 25 are substantially perpendicular to the segments 20 and to the central element 15. In one embodiment, in the collapsed position, the arms assume an angle of between substantially 10 degrees and 30 degrees relative to the segments and relative to the central element. For purposes herein, the term "substantially" when used with reference to an angle means plus or minus ten degrees.

Figure 3:
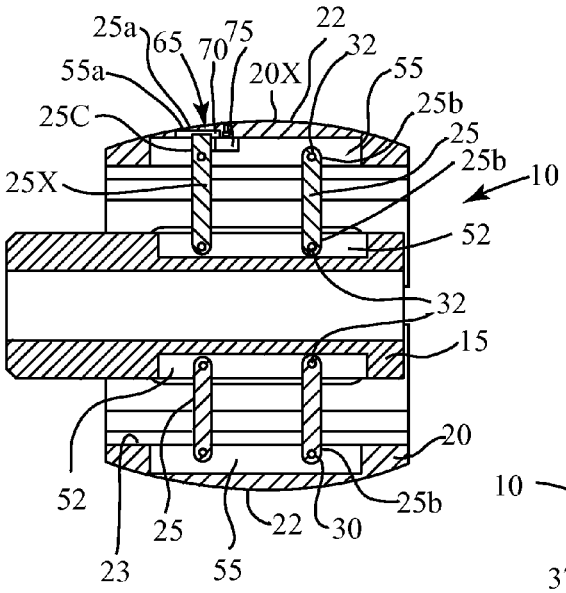
FIG. 3 is a cross-sectional view through the mandrel of FIG. 1 in an expanded position.
Figure 4:
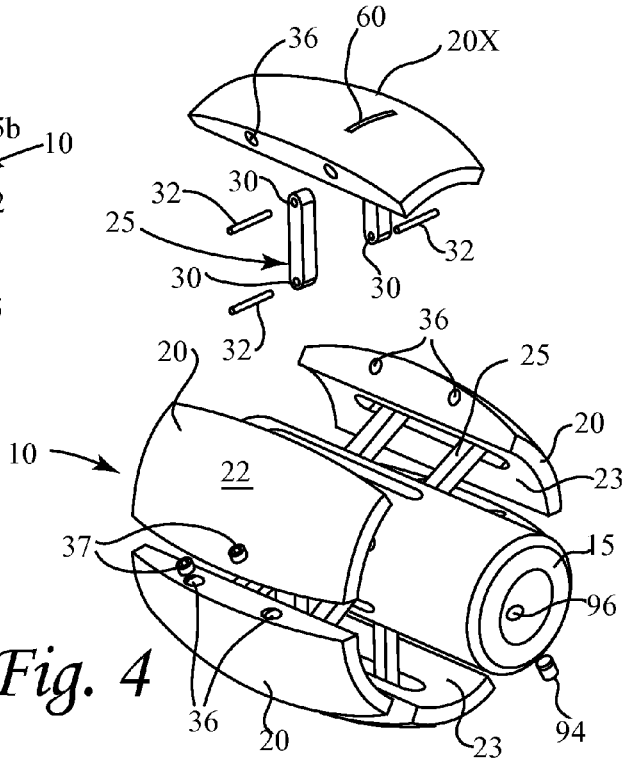
FIG. 4 is a partially exploded view of the mandrel of FIG. 1 in an expanded position.

As seen best in FIG. 3, the central element 15 is provided with a plurality of radially displaced slots 52 defined along an exterior surface of the central element to accommodate rotation of the arms 25 at least partially down into the slots during movement of the mandrel 10 into the collapsed position. The slots 52 may be called "horizontal" slots, although direction is relative, so that for purposes herein, "horizontal" and "vertical" are to be considered the same. However, both may be compared to "radial" which is different. It will be appreciated that the pins 32 extend across the slots 52.

Also as seen best in FIG. 3, each segment 20 is provided with a horizontal slot 55 defined along the inner surface of the segment to accommodate rotation of the arms 25 (25X) at least partially down into the slot 55 during movement of the mandrel into the collapsed position. Again, pins 32 extend across slot(s) 55.

As seen in FIGS. 1-5, at least one of the segments (notated 20X) is provided with a radially extending groove 60 that extends radially across a substantial portion of the bowed segment along the outer surface 22 of the segment. The radially extending groove 60 has a portion that is deep enough to transversely intersect the interior slot 55, thereby providing an opening 65 (seen in FIGS. 3 and 7) through that segment from the exterior of that segment to the interior of that segment. A resilient pad 70 is attached to a (non-resilient, e.g., metal) support element 75 and fixed in the slot 55 of the segment using a screw, bolt or rivet 77 extending through the support element 75 and into the segment 20. The resilient pad 70 is positioned relative to the opening 65 so that a face 78 of the pad 70 is adjacent the opening 65. The resilient pad 70 may be attached in any manner to the support element, such as by glue.

As seen best in FIG. 3, an arm (notated 25X) attaching segment 20X to the central element 15 is located so that a surface 25*a* of the arm 25X is adjacent the pad 70. More particularly, the arm of the segment is located so that when the arm is an extended position, the surface 25*a* of arm 25X either contacts the face 78 of the resilient pad 70 or is within a distance of less than a diameter of a wire that is to be wound around the mandrel. In one embodiment, the surface 25*a* of arm 25X is within a distance of half a diameter of a wire that is to be wound around the mandrel. When the arm 25X is rotated towards a collapsed position, the surface 25*a* of the arm 25X moves away from the face 78 of the resilient pad 70.

Figure 5:
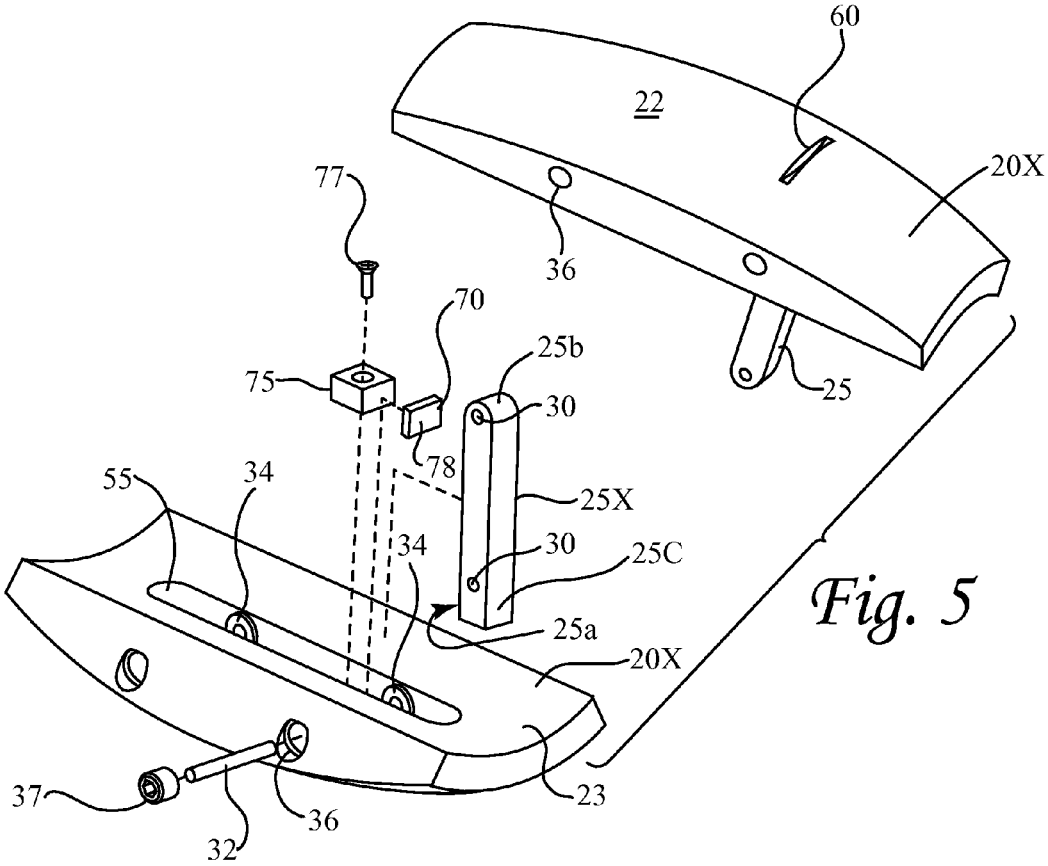
FIG. 5 is an exploded back view of a segment of the mandrel of FIG. 1.
Figure 6:
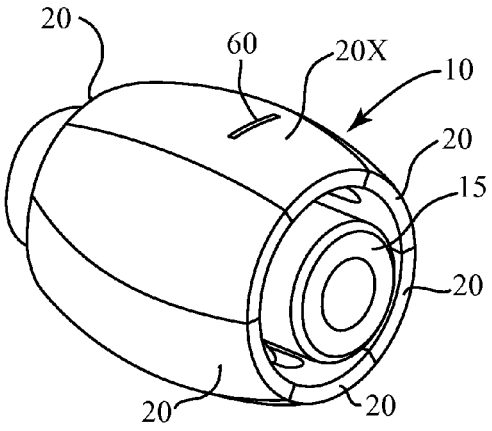
FIG. 6 is a perspective view of the mandrel of FIG. 1 in a collapsed position.
Figure 7:
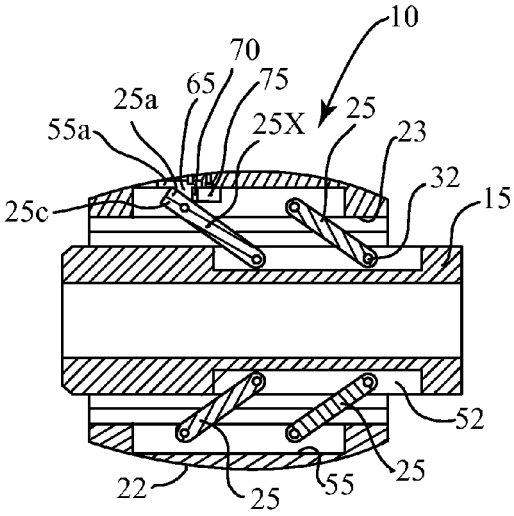
FIG. 7 is a cross-section view of the mandrel of FIG. 1 in a collapsed position.

In one embodiment, arms 25 have ends 25*b* that are rounded in one direction with the rounded ends of the arms defining the holes 30. In one embodiment, as seen in FIGS. 3 and 5, one end 25*c* of arm 25X extends past hole 30 to provide surface 25*a*. In one embodiment, surface 25*a* is flat. In one embodiment, seen best in FIG. 3, the horizontal slot 55 of segment 20X is extended at 55*a* to accommodate the extended end 25*c* of arm 25X and permit rotation thereof.

In one aspect, the mandrel 10 may be of any size. By way of example and not by way of limitation, the mandrel may have a diameter of 10 inches at the middle, 8.5 inches at the top and bottom (or right and left sides), and the segments may be between 8 and 8.5 inches long.

In one aspect, the resilient pad 70 may be made of any resilient material. By way of example and not by way of limitation, the resilient pad 70 may be made of rubber or synthetic rubber. In one aspect, the resilient pad 70 may be of any thickness and any height provided it fits inside the slot 55 defined in the inner side of the segment 20X. By way of example and not by way of limitation, a rubber pad may be between 0.0625 and 0.5 inches thick and between 0.25 and 0.5 inches high.

In one aspect, the opening 65 defined by the radially extending groove 60 and the slot 55 may be of any reasonable size provided it will accommodate the wire material that is extending therethrough. By way of example and not by way of limitation, for a wire of between 0.04 inches and 0.1 inches in diameter the opening may be between 0.375 inches and 0.75 inches long and between 0.15 and 0.35 inches wide.

Figure 8:
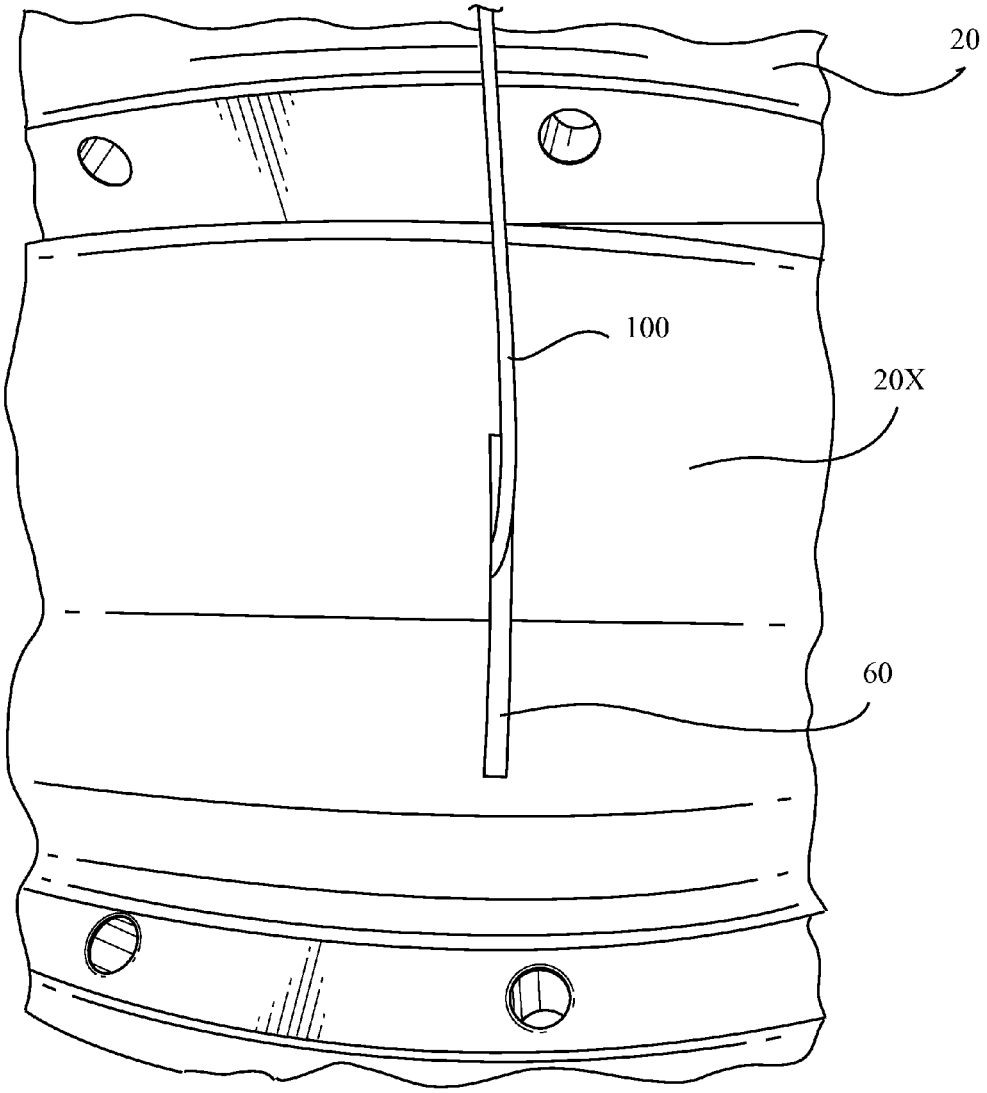
FIG. 8 is a partial side view of the mandrel of FIG. 1 in an expanded position with a wire extending from an opening therein.

In one aspect, the radially extending groove 60 may have a flat bottom profile such that the groove is deeper in the middle (where it forms the opening 65 with the slot 55) and tapers as it extends radially to where it stops on each side. With such an arrangement, only a portion of the groove 60 forms an opening 65 with the slot 55. The remainder of the groove permits a wire 100 (seen in FIG. 8) to angle radially out of the opening 65, into the groove 60 and then onto the outer surface 22 of the segment 20X.

In one aspect, the width of the groove 60 can be approximately twice the width of the wire 100 being wound the mandrel, or smaller, but is larger than the diameter of the wire 100.

In one aspect, with the provided mandrel 10, the end of a wire 100 that is to be wound around the mandrel can be inserted from the radial groove side into the opening 65 defined by the radial groove 60 and the slot 55*a*, 55 of the segment 20X when the segment is in its collapsed position. The segment may then be moved into its extended position, and the wire will be squeezed (pinched) between the resilient pad 70 and the contact surface 25*a* of arm 25X and will extend along the radial groove 60 until it reaches the surface 22 of the segment 20X. The wire 100 can then be wound around the mandrel by placing the central element 15 on a motor shaft (not shown), fixing the mandrel to the shaft using a set screw 94 extending through a hole 96 of the central element (seen in FIG. 4), running the motor which rotates the mandrel, and by controllably moving a traverse (not shown) that guides the wire laterally relative to mandrel 10. When a desired length of wire is wound, the wire package on the mandrel 10 can be removed from the mandrel 10 by cutting the wire 100 (if necessary), collapsing the mandrel 10 from its extended position into the collapsed position, thereby releasing the wire 100 from between the resilient pad 70 and the arm 25X, and lifting the package off of the mandrel 10.

In one aspect, the provided mandrel is particularly useful with brittle wire.

In one embodiment, the metal spacer 75 to which the resilient pad 70 is fixed in the slot 55 of segment 20X is movable in the slot to a plurality of different locations and then fixed at a desired one of the plurality of different locations.

In one embodiment, the slot mandrel segments are curved in two directions so that the segments form a barrel-shaped form.

There have been described and illustrated herein several embodiments of an mandrel with a wire retainer and a method of using the same. While particular embodiments of the invention have been described, it is not intended that the invention be limited thereto, as it is intended that the invention be as broad in scope as the art will allow and that the specification be read likewise. Thus, while a mandrel with a particular number of segments has been disclosed, it will be appreciated that the mandrel could have a different number of segments. Also, while each segment is shown as being connected to the central cylinder by two arms, it will be appreciated that a different number of arms could be utilized. In addition, while particular angles of movement have been disclosed, it will be understood that the segments can move through different angles of movement. Further, while a hollow cylindrical central element is shown, it will be appreciated that the central element may assume different shapes. It will therefore be appreciated by those skilled in the art that yet other modifications could be made to the provided invention without deviating from its spirit and scope as claimed.

What is claimed is:

1. A mandrel for the winding of wire, comprising:

a central element;

a plurality of arms rotatably coupled to said central element, said plurality of arms each including a first end coupled to said central element and a second end;

a plurality of segments radially extending about and respectively coupled to said central element by said plurality of arms at respective said second ends thereof, said plurality of segments and said plurality of arms adapted to permit said plurality of segments to assume a collapsed first position with said segments relatively nearer to said central element and to assume an extended second position with said segments relatively further from said central element, each of said plurality of segments including an outer surface and an inner surface, said inner surface defining a slot in which said respective second end of a respective arm extends, with a first of said plurality of segments defining a radially extending groove in an outer surface of that segment, said groove and said slot of said first segment intersecting along only a portion of said groove and along only a portion of said slot to define an opening through said first segment;

a resilient pad fixed in said slot of said first segment and having a face located at said opening and adjacent a surface of said second end of an arm coupling said first segment to said central element when said plurality of segments assume said extended second position.

2. A mandrel according to claim 1, further comprising:

a support element to which said resilient pad is coupled, said support element fixed in said slot of said first segment, thereby fixing said resilient pad in said slot.

3. A mandrel according to claim 2, wherein:

said resilient pad is located in said slot of said first segment such that said face of said resilient pad is within a half diameter of the wire from said surface of said second end of said arm coupling said first segment to said central element when said plurality of segments assume said extended second position.

4. A mandrel according to claim 3, wherein:

said resilient pad is located in said slot of said first segment such that said face of said resilient pad touches said surface of said second end of said arm coupling said first segment to said central element when said plurality of segments assume said extended second position.

5. A mandrel according to claim 1, wherein:

said outer surfaces of said plurality of segments are convex in two directions and together assume a barrel shape in said collapsed first position.

6. A mandrel according to claim 5, wherein:

said radially extending groove has a flat bottom profile such that the groove is deeper in its middle where it forms said opening and tapers in depth as it extends radially.

7. A mandrel according to claim 1, wherein:

said central element is a central hollow cylindrical element.

8. A mandrel according to claim 7, wherein:

said central element has an outer surface defining a plurality of second slots in which said first ends of said plurality of arms rotate.

9. A method of attaching a wire to be wound around a mandrel to the mandrel, comprising:

providing a mandrel having (i) a central element, (ii) a plurality of arms rotatably coupled to said central element, said plurality of arms each including a first end coupled to said central element and a second end, (iii) a plurality of segments radially extending about and respectively coupled to said central element by said plurality of arms at respective said second ends thereof, said plurality of segments and said plurality of arms adapted to permit said mandrel to assume a collapsed first position with said segments relatively nearer to said central element and to assume an extended second position with said segments relatively further from said central element, each of said plurality of segments including an outer surface and an inner surface, said inner surface defining a slot in which said respective second end of a respective arm extends, with a first of said plurality of segments defining a radially extending groove in an outer surface of that segment, said groove and said slot of said first segment intersecting along only a portion of said groove and along only a portion of said slot to define an opening through said first segment, and (iv) a resilient pad fixed in said slot of said first segment and having a face located at said opening and adjacent a surface of said second end of an arm coupling said first segment to said central element when said plurality of segments assume said extended second position;

placing said mandrel in said collapsed first position;

threading an end of said wire from said radial groove into said opening and adjacent said resilient pad;

causing said plurality of arms to rotate said plurality of segments and move said mandrel into said extended second position, thereby pinching and retaining said end of said wire between said surface of said second end of said arm coupling said first segment to said central element and said resilient pad.

10. A method according to claim 9, further comprising:

winding said wire around said mandrel to generate a package of wound wire by rotating said central shaft with said mandrel in said extended second position.

11. A method according to claim 10, further comprising:

after said winding, causing said plurality of arms to rotate said plurality of segments and move said mandrel into said first collapsed position, thereby releasing said end of said wire from said pinching and retaining.

12. A method according to claim 11, further comprising:

removing said package of wound wire from said mandrel.

13. A method according to claim 10, wherein:

said winding comprises winding said wire in a figure-eight configuration.

14. A method according to claim 10, wherein:

said resilient pad is located in said slot of said first segment such that said face of said resilient pad is within a half diameter of the wire from said surface of said second end of said arm coupling said first segment to said central element when said mandrel assumes said extended second position.

15. A method according to claim 14, wherein:

said resilient pad is located in said slot of said first segment such that said face of said resilient pad touches said surface of said second end of said arm coupling said first segment to said central element when said mandrel assumes said extended second position.

16. A method according to claim 9, wherein:

said outer surfaces of said plurality of segments are convex in two directions and together assume a barrel shape in said collapsed first position.

17. A method according to claim 16, wherein:

said radially extending groove has a flat bottom profile such that the groove is deeper in its middle where it forms said opening and tapers in depth as it extends radially.

* * * * *